US010486045B2

(12) United States Patent
Benjamin

(10) Patent No.: US 10,486,045 B2
(45) Date of Patent: Nov. 26, 2019

(54) HIGH-STABILITY STREET HOCKEY PUCK

(71) Applicant: Aaron D. Benjamin, Davis, CA (US)

(72) Inventor: Aaron D. Benjamin, Davis, CA (US)

( * ) Notice: Subject to any disclaimer, the term of this patent is extended or adjusted under 35 U.S.C. 154(b) by 0 days.

(21) Appl. No.: 16/116,184

(22) Filed: Aug. 29, 2018

(65) Prior Publication Data

US 2019/0070475 A1 Mar. 7, 2019

Related U.S. Application Data

(60) Provisional application No. 62/553,811, filed on Sep. 2, 2017.

(51) Int. Cl.

*A63B 67/14* (2006.01)
*A63B 69/00* (2006.01)
*A63B 102/22* (2015.01)

(52) U.S. Cl.

CPC ..... *A63B 67/14* (2013.01); *A63B 69/0024* (2013.01); *A63B 2102/22* (2015.10); *A63B 2209/00* (2013.01)

(58) Field of Classification Search

CPC ... A63B 67/14; A63B 43/002; A63B 2102/22; A63B 69/0024; A63B 2209/00
USPC ..... D21/710
See application file for complete search history.

(56) References Cited

U.S. PATENT DOCUMENTS 3,092,389 A * 6/1963 Smith ..... A63B 67/14 473/588
3,726,526 A * 4/1973 Radovich ..... A63B 67/14 473/588
5,284,343 A * 2/1994 Bigornia ..... A63B 21/0603 473/446
5,348,298 A * 9/1994 Montgomery ..... A63B 67/14 473/446
5,518,237 A * 5/1996 Bellehumeur ..... A63B 21/0603 473/588
5,697,858 A * 12/1997 Lekavich ..... A63B 67/14 473/588
5,816,965 A 10/1998 Kotler
5,855,528 A 1/1999 Aiello
D409,700 S * 5/1999 Kotler ..... D21/710
D413,368 S * 8/1999 Kotler ..... D21/710
D415,804 S * 10/1999 Kotler ..... D21/710
5,976,042 A * 11/1999 LaMarche ..... A63B 67/14 473/588
6,010,418 A * 1/2000 Lekavich ..... A63B 67/14 473/588
6,089,998 A * 7/2000 O'Neal ..... A63B 67/14 473/588
6,126,561 A 10/2000 Mark
6,146,293 A * 11/2000 Chinn ..... A63B 67/14 473/588

(Continued)

*Primary Examiner* — Raleigh W Chiu
(74) *Attorney, Agent, or Firm* — Mersenne Law

(57) ABSTRACT

Tough, low-friction street hockey pucks are constructed as regular prismatic cylinders or prismatic cylinders having alternating side profiles. An internal chamber partially filled with a granular material such as sand, gravel or metal shot, or fluids such as water, oil, alcohol or ethylene glycol, and combinations thereof, helps deter a rolling motion of the puck and causes it to fall down and slide. The sliding motion is more similar to an ice-hockey puck traveling over ice, so practicing with the inventive street-hockey puck is more like ice-hockey practice.

19 Claims, 6 Drawing Sheets

(56) References Cited

U.S. PATENT DOCUMENTS

| | | | | |
|---|---|---|---|---|
| 6,277,042 | B1 * | 8/2001 | Lekavich | A63B 67/14 473/588 |
| 2005/0209030 | A1 * | 9/2005 | Verrengia | A63B 67/14 473/588 |
| 2008/0300072 | A1 * | 12/2008 | Harpell | A63B 67/14 473/446 |
| 2015/0057116 | A1 * | 2/2015 | Pederson | A63B 67/14 473/588 |
| 2017/0312587 | A1 | 11/2017 | Goldwitz | |
| 2019/0070475 | A1 * | 3/2019 | Benjamin | A63B 67/14 |

* cited by examiner

Fig. 2A
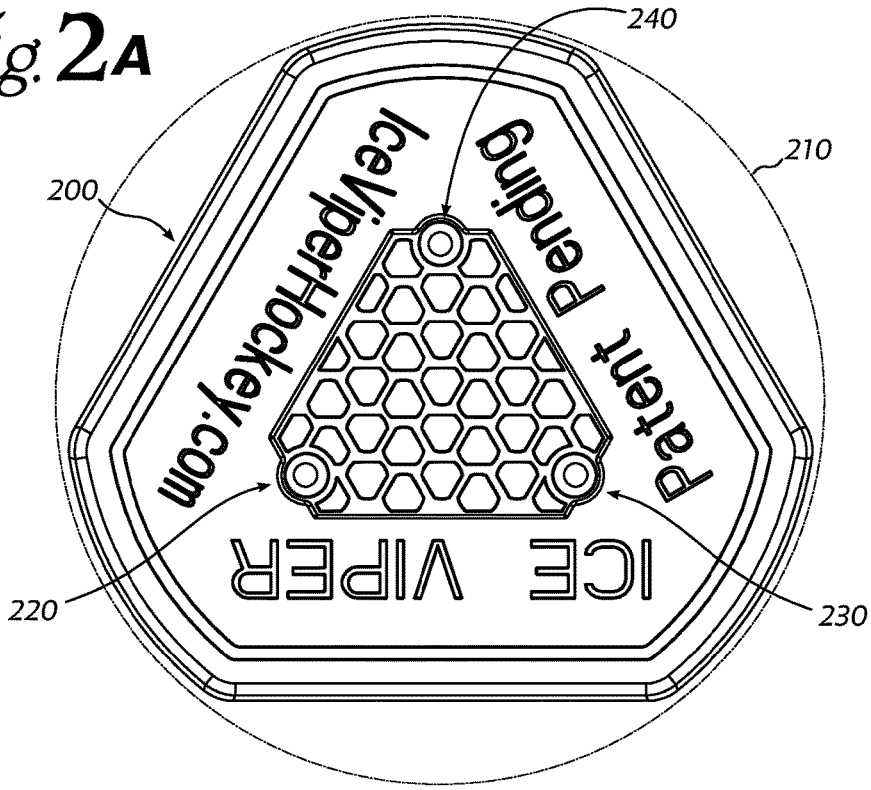
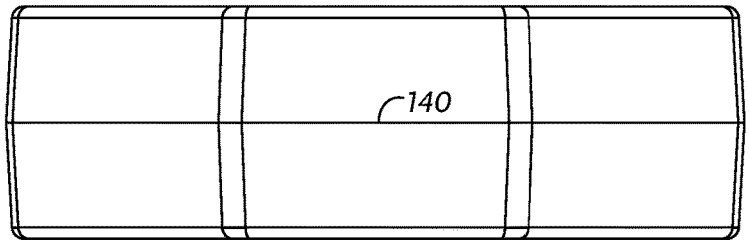
Fig. 2B
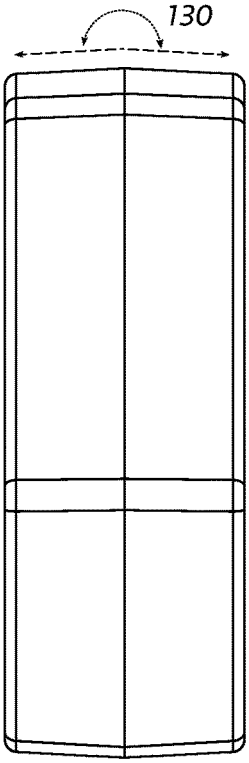
Fig. 2C

Fig. 3
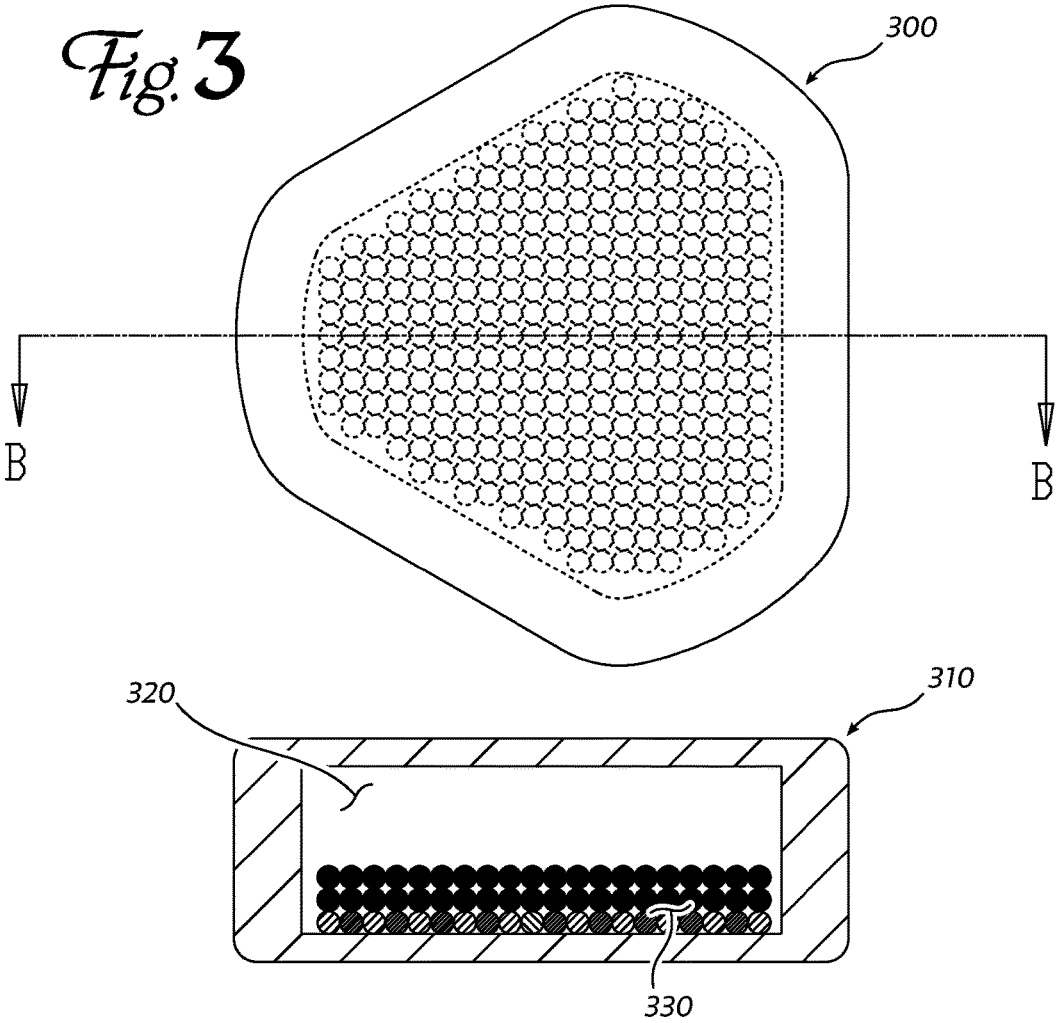
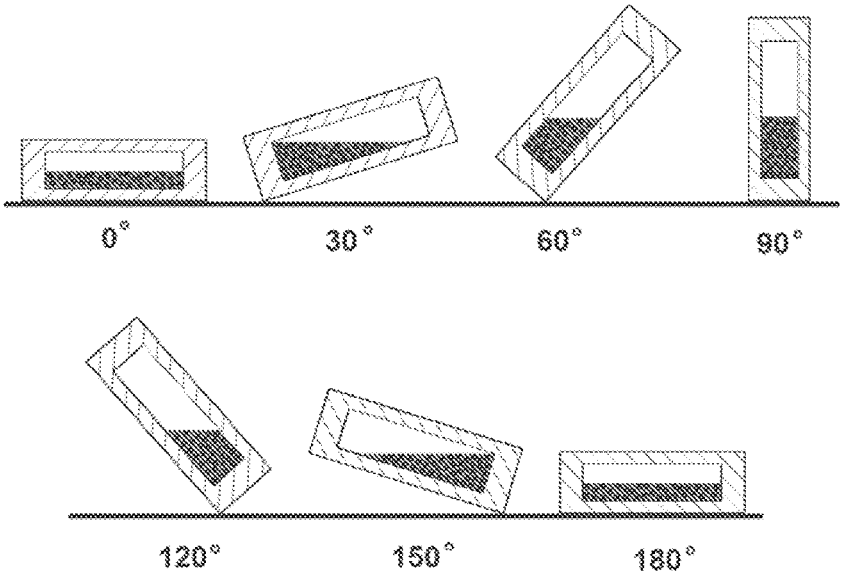
Fig. 4

HIGH-STABILITY STREET HOCKEY PUCK

CONTINUITY AND CLAIM OF PRIORITY

This is an original U.S. patent application that claims priority to U.S. Provisional Patent Application No. 62/553,811 filed 2 Sep. 2017, which is incorporated by reference.

FIELD

The invention relates generally to a street hockey puck. More specifically, the invention relates to configurations and internal structure of a street hockey puck to make the puck handle more like an ice-hockey puck on ice.

BACKGROUND

A normal ice-hockey puck is a disc 3 inches in diameter, 1 inch thick, and about 6 oz. in weight, intended to slide along a surface on one of the two flat ends (top or bottom.) Street hockey pucks are intended to simulate the sliding motion of a rubber puck on ice, however the conditions seen by a street hockey puck on land are different from those seen by a rubber puck on ice. Unfortunately, these off-ice conditions prove challenging when designing a street hockey puck that emulates the handling and feel of a rubber puck on ice. There are many types of street hockey pucks; some perform better than others in emulating this on-ice feel.

Compared to ice hockey pucks, street hockey pucks must contend with higher friction and a greater roughness of the terrain over which they travel. Generally, this destabilizes the sliding motion of the puck, causing it to flip up on its side and roll.

The increased level of friction makes it more likely for a street hockey puck to tip from a stable sliding position onto its narrow cylindrical face. Because of increased friction, a puck that flips onto its side is also likely to begin rolling along the ground as its kinetic energy is quickly translated into rotational kinetic energy. A puck rolling on ice is much easier to handle than a puck rolling on pavement. A puck rolling off-ice becomes unpredictable, and difficult to tip flat. Furthermore, once a puck starts rolling on the ground, the angular velocity/momentum of the puck adds a stability to its undesirable rolling orientation making it even more difficult to knock back down to its flat, sliding orientation. The lower level of friction on ice makes it much easier to knock a tipped puck back down. To make matters worse, attempts to knock a rolling puck down on land often add energy to the puck, increasing angular velocity/momentum of the puck and making it even more difficult to knock flat.

In addition to friction, the rougher terrain also increases the likelihood of the puck tipping up on its side. As a puck slides over variations in surface topography, the puck can be "tossed" as if sliding off a ramp. Ice is much smoother and less rough.

Furthermore, higher friction on street surfaces such as asphalt throws off the grip-ratio, $$\frac{\mu_{Puck/Surface1}}{\mu_{Puck/Stick}} : \frac{\mu_{Puck/Surface2}}{\mu_{Puck/Stick}},$$

where $\mu_{A/B}$ represents the coefficient of friction between material "A" and material "B." The coefficient of friction between a round puck on the blade of a hockey stick is the same whether the puck is sliding on ice or asphalt. However, the coefficient of friction between the puck and the playing surface is much higher on asphalt than it is on ice. This discrepancy between the grip ratios $$\frac{\mu_{Puck/Ice}}{\mu_{Puck/Stick}} \neq \frac{\mu_{Puck/Asphalt}}{\mu_{Puck/Stick}}$$

results in inconsistent puck handling when transitioning between ice and off-ice playing surfaces.

SUMMARY

Embodiments of the invention are street-hockey pucks comprising features to reduce, eliminate or compensate for the instability issues experienced by such a hockey puck, for a truer emulation of on-ice puck handling. The inventive puck's stability in the sliding, flat orientation is significantly improved. In addition, an embodiment comprises features to destabilize or dissipate energy if the puck begins to tip up or roll, so that it is more likely to return to the desired sliding configuration more rapidly.

BRIEF DESCRIPTION OF DRAWINGS

FIGS. 2A-2C show orthogonal views of an embodiment of the invention.

FIG. 3 is a cutaway view showing the internal chamber of an embodiment.

FIG. 4 shows how the granular fill of an embodiment moves as the embodiment tilts and rotates.

DETAILED DESCRIPTION

Embodiments of the invention are similar to ideal geometric volumes known as prisms. A prism is a volume constructed by translating a planar polygon in a direction out of the plane of the polygon. (If a circle is translated instead of a polygon, the result is a cylinder.) The ends of a prism are usually parallel. The planar polygon may be rotated as it is translated, which imparts a twist to the walls of the cylinder, somewhat like the thread of a screw.

An embodiment of the invention preferably has curved (rather than sharp) edges and corners. These shapes may be modeled by translating a closed planar curve in a direction out of the plane of the curve—embodiments are generally similar to right prisms, so their constituent curves are translated perpendicularly to the plane. The curves are convex—that is, a line drawn between any two points on the curve will always pass entirely across the area bounded by the curve, and never intersect any point outside the curve. The phrase "prismatic cylinder" will be used to refer to the shape of an embodiment. The shape is similar to a geometric prism, but it is not exactly a geometric prism because some or all of the walls (as well as the end faces) may be curved.

Figure 1:
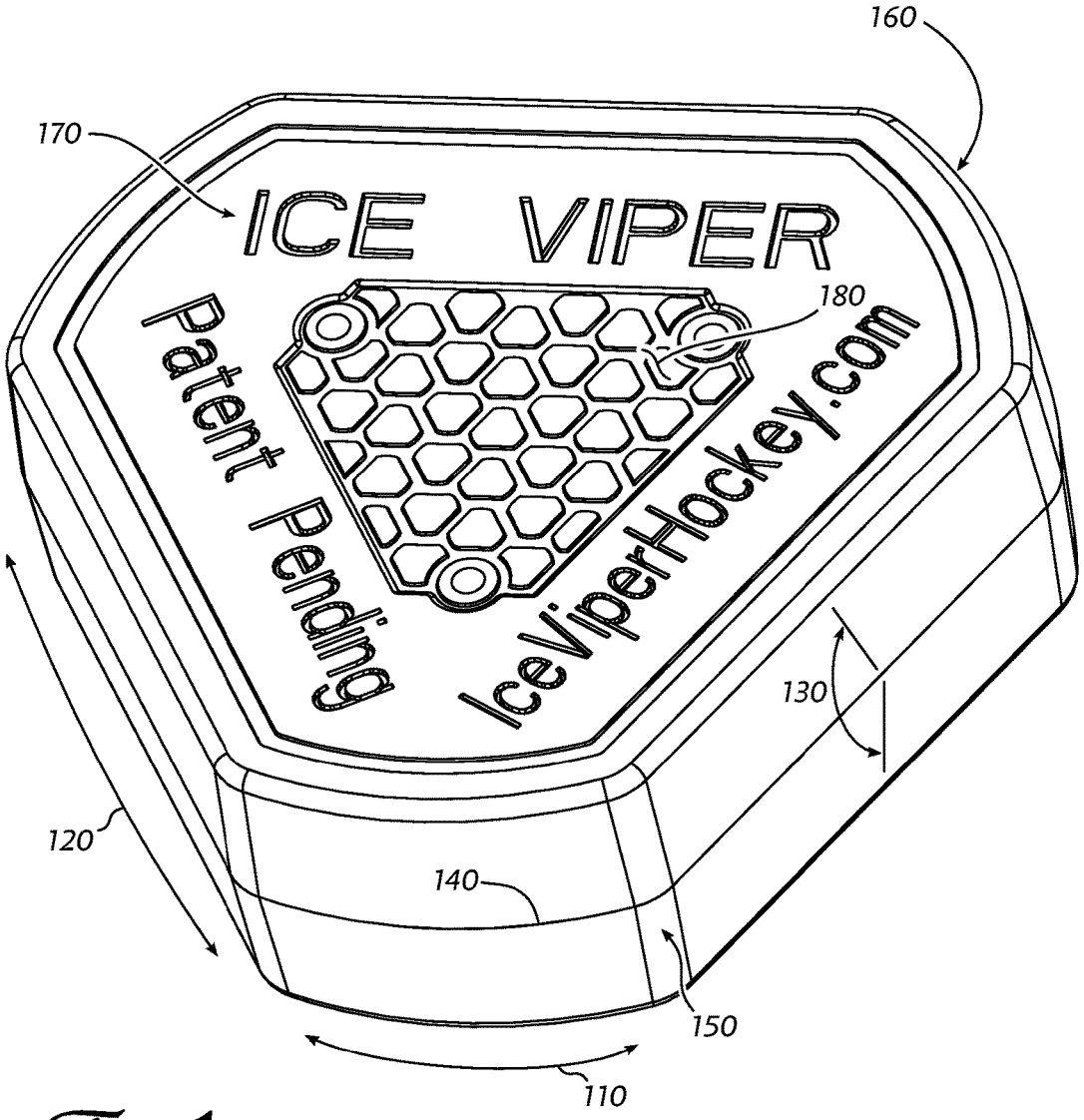
FIG. 1 is a general perspective view of a typical embodiment of the invention.

FIG. 1 shows an exemplary embodiment of the invention. It is a six-sided prismatic cylinder. Three of the sides (e.g. 110) have a smaller radius, while three alternating sides (e.g. 120) have a larger radius—in this embodiment, the larger-radius sides are, for all intents and purposes, straight. Draft angles 130 symmetric to the parting line or "equator" 140 are incorporated into the prismatic cylinder for the purpose of mold release in manufacture of the puck. These draft angles have negligible effect on the overall form and function of the geometry described.

Seams between adjacent sides are beveled, radiused or otherwise relieved as shown at 150. Top and bottom peripheral edges are treated similarly (160). Top and bottom surfaces (i.e., the end faces of the prismatic cylinder) may be adorned with text 170 or graphic patterns 180. An embodiment is preferably about as thick as a standard ice-hockey puck (about 1") and should have a similar plan-view area (a 3" circular hockey puck has an area of about 7 square inches). A similar weight (5.5 to 6 oz) is also preferred. However, slightly smaller or larger, thicker or thinner, heavier or lighter pucks may be preferred for certain uses. An embodiment will be between about ¾" and ½" thick, between 2" and 4" in diameter, and weigh between 4 and 8 oz. (It is appreciated that "diameter" only refers to circular objects, whereas most embodiments have a convex polygon plan view. Thus, for measurement purposes, the diameter will be defined as the smallest circle surrounding the polygon or closed-curve shape of the embodiment.)

Embodiments may have from three to about six pairs of sides, arranged in an alternating small-radius, large-radius (or straight) pattern like that shown in FIG. 1. The large-radius sides are preferably longer than the small-radius segments, so that the embodiment cannot roll smoothly—rolling being an undesired motion for an embodiment. The top and bottom faces of an embodiment may be substantially flat, or may have a slight convex or concave curvature.

As discussed above, the high friction between an off-ice puck and the ground throws off the grip ratio. The preferred embodiment of this invention compensates for this discrepancy utilizing the geometry of a prismatic cylinder of a polygon rather than a prismatic cylinder of a circle. A shape with relatively flat sides (as in a prismatic cylinder of a polygon) sliding against a relatively flat surface (as in the blade of a hockey stick) has a much higher sliding coefficient of friction than the rolling coefficient of friction between a round shape (as in a prismatic cylinder of a circle) of an identical material, rolling against an identical relatively flat surface (as in the blade of a hockey stick.) By increasing $\mu_{Off\text{-}Ice\text{-}Puck/Stick}$, the grip ratio can be balanced:

$$\frac{\mu_{RoundPuck/Ice}}{\mu_{RoundPuck/Stick}} \cong \frac{\mu_{PolyhedralPuck/Asphalt}}{\mu_{PolyhedralPuck/Stick}}$$

FIGS. 2A-2C show orthogonal views of an embodiment. The top and bottom views are essentially identical (FIG. 2A). Outside edge or boundary 200 is the closed convex curve that describes the shape of the prismatic cylinder. Its "diameter" is indicated by circle 210. Since the top and bottom of an embodiment may be identical, an efficient manufacturing method is to make a single component configured so that one copy can be inverted and secured to another copy along an "equator" line 140, seen in front view FIG. 2B. The two halves of such an embodiment may be secured by adhesive, thermal or chemical welding, mechanical fasteners, or a combination of such techniques. FIG. 2A shows where three such fasteners may be placed, at 220, 230, 240. Side view FIG. 2*c* shows the draft angle 130, mentioned above, which improves manufacturability of the halves.

An embodiment further comprises at least one internal chamber or void, as shown in FIG. 3. 300 is a plan view of an embodiment like that shown in FIG. 1. 310 is a cross-section view taken at B-B, where the internal chamber 320 is apparent. The chamber is partially but not completely filled by a granular material 330. This may be a natural material such as sand or gravel, or a processed material similar to ball bearings. Either regular or irregular particles may be used. In one embodiment, a plurality of differently-sized metal orbs (e.g., metal shot) may be inserted.

Since the granular material does not completely fill chamber 320, it tends to accumulate at the lowest point of the chamber, as illustrated in FIG. 4. If the inventive puck begins to flip up onto an edge, the granular material stays near the lower parts of the internal chamber, thus lowering the center of gravity of the device. This makes the puck less likely to begin rolling or to continue rolling, and more likely to return to its desired flat, sliding position.

Further improving stability is the granular damping mechanism enabled by the granular fill. The linear granular damping mechanism is effective in stabilizing a sliding puck travelling over rough terrain. As the puck jostles over bumps in the ground, the granular fill experiences impacts. After these impact events, the particles densely packed at the bottom of the puck transition into a particle cloud in which individual particles may have velocities in all directions including directions parallel to the playing surface. By conservation of momentum, the rebound velocity of the puck out of the impact is necessarily reduced, while the kinetic energy imparted to the system upon impact quickly dissipates due to interparticle collisions and friction. *C.f. Rebound of a confined granular material: combination of a bouncing ball and a granular damper*, F. Pacheco-Vásquez & S. Dorbolo, Scientific Reports 3:2158, 9 Jul. 2013. Thus the puck bounces less and is less likely to tip up on end and roll away, compared to a similar puck without granular fill.

Unique to a puck with a non-round geometry is the improved ability to dissipate the rotational energy in the rolling orientation. In addition to energy abatement of linear impact events in a sliding puck, a polygonal puck in a rolling orientation also imparts linear impact events to the granular fill as each corner contacts the ground. Again, because of conservation of momentum of the particle-puck system and the energy lost to inter-particle collisions, the granular fill also aids in abating the rotational energy of the puck. Thus, utilization of granular fill in a non-round puck uniquely enables omnidirectional damping in both sliding rolling orientations for marked improvements in stability, handling, and ease of transitions out of the undesired rolling orientation into the desired sliding orientations.

An embodiment may include a fluid in the internal chamber. A chamber fill such as water, oil, alcohol or ethylene glycol, has higher viscosity than the plain gaseous atmosphere occupying all or some the "empty" portion of a partially-filled chamber. The particles moving in a fluid may dissipate bouncing and rolling energy more effectively than the same particles in a gas-filled space. The liquid fill may occupy some, most or all of the internal chamber that is not occupied by the granular fill. By conservation of momentum, the higher the ratio of the fill mass to the rigid mass of the puck, the more effective the fill is at reducing rebound velocity. Within a finite chamber, geometric constraints place an upper limit on this statement related to the height of the roof of the internal chamber. Given a sufficient magnitude of impact, the fill can impact the roof of the chamber, thereby returning its momentum to the rigid puck shell, partially negating the effectiveness of the fill. *C.f. Rebound of a confined granular material: combination of a bouncing ball and a granular damper*, F. Pacheco-Vásquez & S. Dorbolo, Scientific Reports 3:2158, 9 Jul. 2013. Thus, given a chamber volume and fill material, increasing fill mass inherently reduces this unoccupied space above the fill, thereby limiting efficacy of the fill. Yet, holding fill mass constant while increasing either density and/or packing efficiency of the settled fill increases the roof height of the chamber above the uppermost surface of the fill, thereby increasing the magnitude of an impact that the puck can successfully stabilize. For a desired fill mass, this increase in density and/or packing efficiency can be accomplished through one or a combination of several means: 1) via a multi-phase fill (the cumulative volume of which is less than the volume of the empty chamber) utilizing solid particles combined with a liquid which can fill the voids between solid particles, 2) via a polydisperse granular media in which the smaller particles fill the voids between the larger particles, 3) via lubricating the granular fill with a surface coating of oil or graphite to facilitate slip between particles and achieve a more densely packed settled arrangement, and 3) utilizing granular media comprising intrinsically dense bulk materials (like tungsten, lead, bismuth, copper, brass, or steel.)

Figure 5:
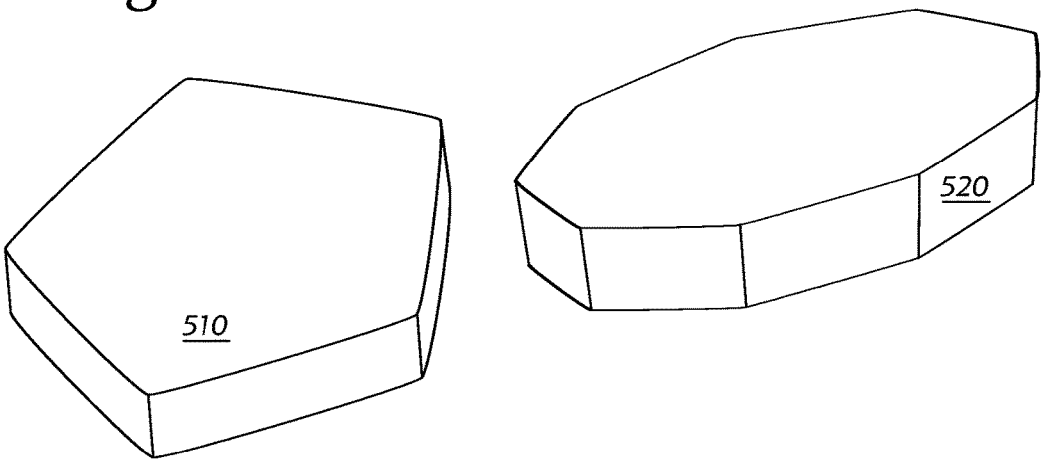
FIG. 5 shows some example regular-polygonal embodiments.

FIG. 5 shows several further embodiments of the invention. These are regular prismatic cylinders—all of their sides are the same. However, they retain the internal chamber or void, partially filled with granular material. A regular-prism embodiment may have between about five sides (510) and about twelve sides (embodiment 520 has nine sides), with beveled, radiused or relieved edges and optionally domed or convex upper and lower faces. The upper- and lower-face polygons may have identical numbers of faces, or may have different numbers of faces.

Figure 6:
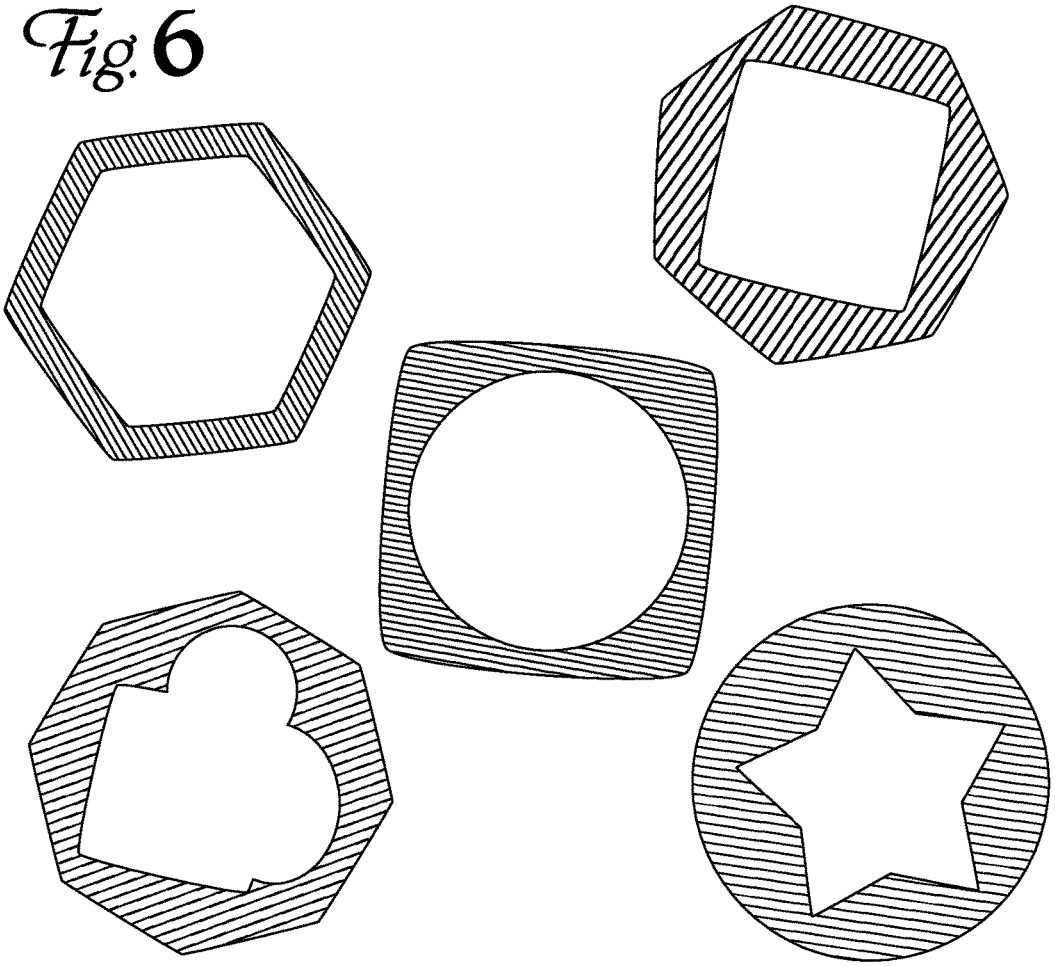
FIG. 6 shows a variety of outer and inner shapes that may be used in an embodiment.

FIG. 6 shows that the internal chamber may be shaped similarly to the outer periphery, or it may have a different shape. This may be a different convex polygon, a circle (cylinder) or a completely irregular shape. Some embodiments may use a cylindrical outer shape, but a polygonal or irregular inner shape. A round puck with a non-round chamber discourages rolling via means similar to the non-round puck itself. When the puck rolls, linear impact events between the granular material and the various faces and corners of the polygonal or irregular cavity assist in abating the rotational kinetic energy of the puck.

Figure 7:
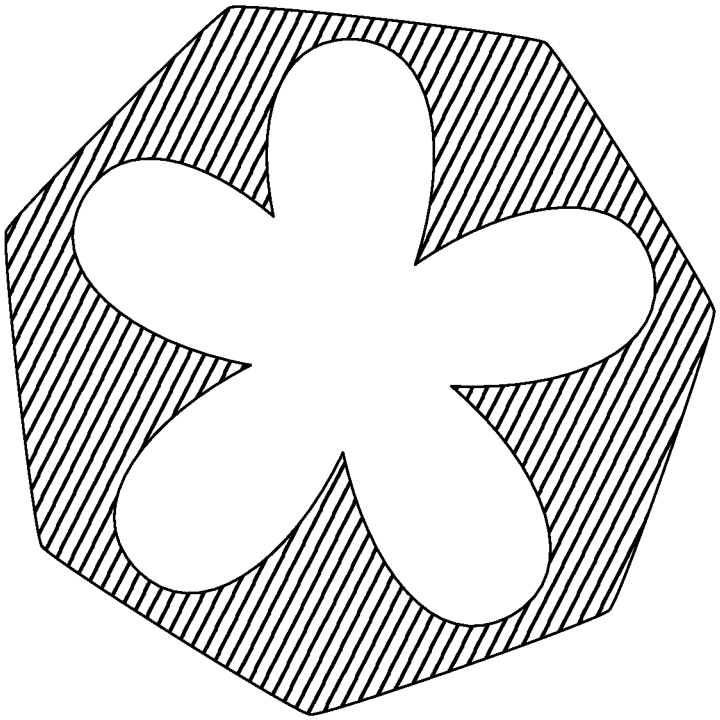
FIG. 7 shows an embodiment with a differently-shaped internal chamber.
Figure 8:
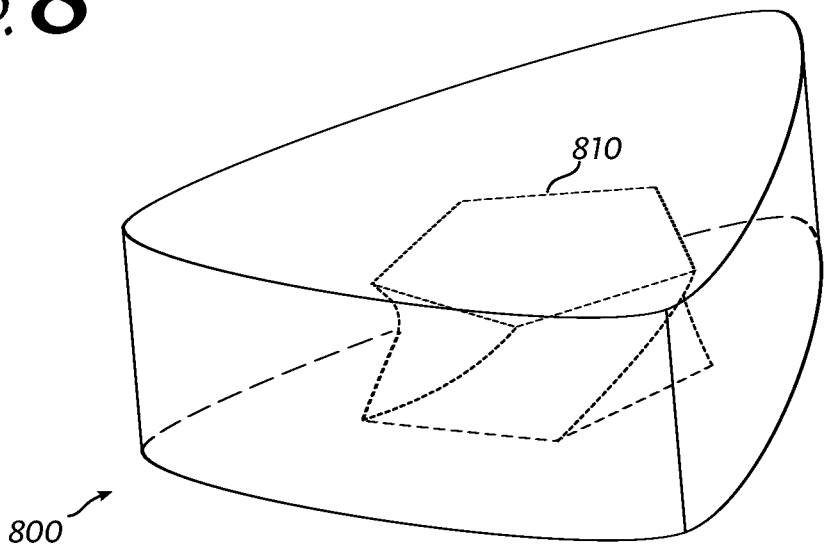
FIG. 8 shows an embodiment with a twisted internal chamber.

In some embodiments, the internal chamber may be shaped with multiple partially-separated lobes, as shown in FIG. 7. The granular fill moves erratically from lobe to lobe if the puck begins to roll, impeding the rolling motion and encouraging the puck to fall down and resume sliding. In another embodiment (FIG. 8, triangular puck 800), the walls of the internal chamber 810 may be formed with a twist, similarly to a steep-pitch thread. These walls may preferentially urge the granular fill to one side of the puck if it begins to roll on an edge, causing the puck to fall over to that side and resume the desired sliding motion.

Figure 9:
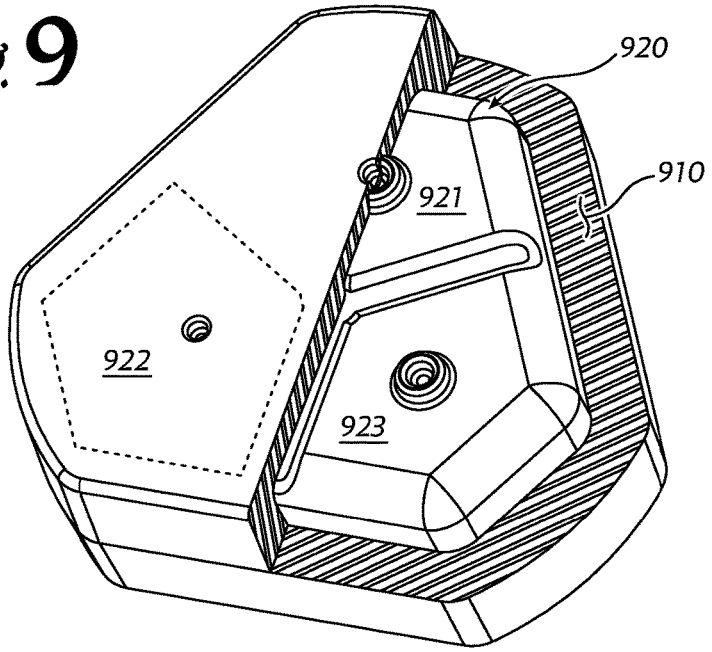
FIG. 9 shows internal features of a preferred embodiment.
Figure 9:
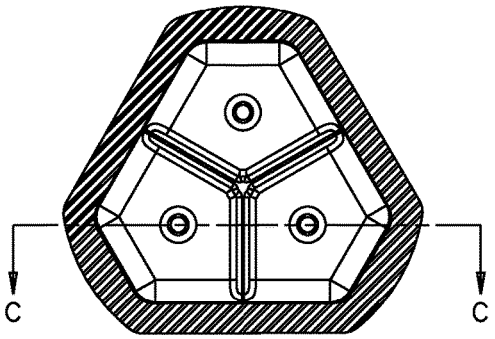
Figure 9:
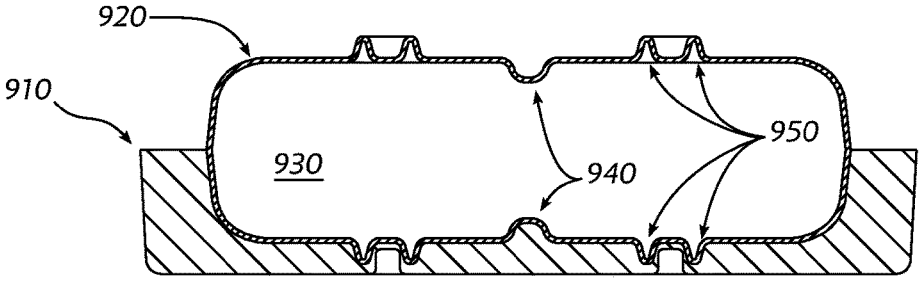

FIG. 9 shows a cutaway view of the internal chamber of a preferred embodiment. An outer cladding 910 surrounds an inner chamber 920, which is partially divided into irregular pentagon shapes 921, 922, 923. A section view shows that the internal volume 930 includes baffles 940 to increase the usable internal volume of the puck while maintaining rigidity and strength of the upper and lower puck surfaces. Additionally, baffles assist in abating the kinetic energy of a rolling puck via impacts of the granular fill with the baffles. Other embodiments make use of baffles asymmetric to the mid-plane which may bias the puck's reactions to granular impact events in one direction or the other, further decreasing stability of a rolling puck. In another embodiment, the thickness of a baffle can extend through the entire depth of the internal chamber, thus forming partitions of multiple independent prismatic chambers.

It is acknowledged that the outer surfaces of the puck will wear down during normal use as it slides along asphalt, pavement, and other hard or rough surfaces. In the preferred embodiment, a core is formed as a hollow shell, comprising the geometry of the internal chamber, which has dimples (e.g. 950) protruding from each end face. These dimples function in both manufacturing and intended use. They allow the core to be suspended in a mold cavity via pins while the outer shell is cast or molded around the core. They also function as wear indicators; they become exposed as the puck end faces wear, indicating the end of the puck's functional wear life, beyond which the puck no longer has the structural integrity necessary for the intended use. For this embodiment, the hollow core has a color with high contrast to the outer puck material.

Pucks according to an embodiment should be made of a tough material such as polyurethane, acrylonitrile butadiene styrene (ABS), polyethylene, polycarbonate, nylon, polypropylene, etc. The outer surface should be a low-friction material. A polytetrafluoroethylene (trade name Teflon®) cladding is suitable, if the base material alone does not have the desired coefficient of friction. Alternatively, inserts made from a low-friction material, protruding from opposing end faces of the puck, can be added for similar effect. One embodiment may comprise an outer cladding of a polyurethane thermoset polymer with an approximate Shore hardness of 65D.

The applications of the present invention have been described largely by reference to specific examples and in terms of particular combinations of the novel elements of embodiments. However, those of skill in the art will recognize that stable, slide-not-roll street hockey pucks that provide a better emulation of ice-hockey puck handling can also be constructed by different combinations of the inventive features. Such variations and alternate implementations are understood to be captured according to the following claims.

I claim:

1. A street-hockey puck comprising:

a shell shaped as a prismatic cylinder having a thickness between ¾" and 1½" and a plan-view profile larger than a 2" diameter circle but smaller than a 4" diameter circle;

an enclosed chamber within the shell; and a granular material partially but not completely filling the enclosed chamber, wherein the plan-view profile of the prismatic cylinder comprises a plurality of segments having a first radius of curvature alternating with an equal number of segments having a second radius of curvature.

2. The street-hockey puck of claim 1 wherein the plurality of segments is three large-radius segments, and the equal number of segments is three small-radius segments.

3. The street-hockey puck of claim 1 wherein the plurality of segments is between three and eight segments.

4. The street-hockey puck of claim 1 wherein opposing end faces of the shell are substantially flat.

5. The street-hockey puck of claim 1 wherein opposing end faces of the shell are either both convex or both concave.

6. The street-hockey puck of claim 1 wherein a shape of the enclosed chamber is similar to a shape of the regular prismatic cylinder.

7. The street-hockey puck of claim 1 wherein a shape of the enclosed chamber is different from a shape of the prismatic cylinder.

8. The street-hockey puck of claim 1 wherein a shape of the enclosed chamber is a regular prismatic cylinder, said regular prismatic cylinder having a different number of sides from the shell shaped as a prismatic cylinder.

9. The street-hockey puck of claim 1 wherein a shape of the enclosed chamber is irregular.

10. The street-hockey puck of claim 1 wherein the enclosed chamber has a multi-lobe shape.

11. The street-hockey puck of claim 10 wherein the multi-lobe shape has an equal number of lobes as the prismatic cylinder has sides.

12. The street-hockey puck of claim 10 wherein the multi-lobe shape has a different number of lobes than the prismatic cylinder has sides.

13. A street-hockey puck comprising:

a housing formed of a tough polymer material as a substantially-regular prismatic cylinder;

an enclosed chamber within the housing; and a granular material partially but not completely filling the enclosed chamber, wherein a substance occupying the enclosed chamber surrounding the granular material comprises at least one of air, nitrogen, carbon dioxide, water, oil, and alcohol, and wherein a first end face of the substantially regular prismatic cylinder and a second, opposing end face of the substantially regular prismatic cylinder are both convex polygons having an area of approximately 7 square inches, a first number of sides of the first end face being different from a second number of sides of the second, opposing end face, and wherein a cross-sectional shape of the enclosed chamber viewed from an end of the substantially-regular prismatic cylinder is one of a convex polygon, an irregular shape or a plurality of partially-separated lobes.

14. The street-hockey puck of claim 13 wherein the first end face has a convex profile or a concave profile.

15. The street-hockey puck of claim 13 wherein the first end face has between five and twelve sides.

16. A street hockey puck comprising:

an outer cladding shaped as a prismatic cylinder having three substantially straight sides interleaved with three curved sides, a length of each substantially straight side exceeding a length of each curved side, said outer cladding formed in two substantially identical halves and joined together along an equator;

an inner chamber having a cross-sectional shape of three similar, irregular pentagons arranged symmetrically within the outer cladding and partially but not completely separated by baffles; and a granular fill material partially but not completely filling the inner chamber.

17. The street hockey puck of claim 16, wherein the outer cladding is formed of a polyurethane thermoset polymer with an approximate Shore hardness of 65D.

18. The street hockey puck of claim 16 wherein the granular fill is steel shot.

19. The street hockey puck of claim 16 wherein the granular fill is lubricated by graphite.

* * * * *